US008041244B2

(12) United States Patent
Kojima

(10) Patent No.: US 8,041,244 B2
(45) Date of Patent: Oct. 18, 2011

(54) IMAGE FORMING APPARATUS

(75) Inventor: Etsuji Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 12/507,711

(22) Filed: Jul. 22, 2009

(65) Prior Publication Data

US 2010/0021193 A1 Jan. 28, 2010

(30) Foreign Application Priority Data

Jul. 24, 2008 (JP) ..... 2008-190942

(51) Int. Cl.
*G03G 15/16* (2006.01)

(52) U.S. Cl. ..... 399/66

(58) Field of Classification Search ..... 399/66, 399/71, 127, 128, 129, 302
See application file for complete search history.

(56) References Cited

U.S. PATENT DOCUMENTS 4,640,606 A * 2/1987 Inamoto ..... 399/66
6,029,022 A * 2/2000 Takase ..... 399/66
6,253,041 B1 * 6/2001 Tomizawa et al. ..... 399/66
2006/0083531 A1 * 4/2006 Shida ..... 399/71
2007/0196118 A1 * 8/2007 Aoki et al. ..... 399/48
2008/0170867 A1 * 7/2008 Ahn et al. ..... 399/13

FOREIGN PATENT DOCUMENTS

JP 60-147780 8/1985
JP 2001-125338 5/2001

* cited by examiner

*Primary Examiner* — Kiho Kim
(74) *Attorney, Agent, or Firm* — Canon USA Inc IP Division

(57) ABSTRACT

An image forming apparatus includes first and second image forming units respectively including first and second photosensitive members and first and second toner image forming devices for forming a toner image on the first and second photosensitive members respectively, and first and second transfer members configured to transfer the toner image formed on the first and second photosensitive members onto the belt member. The second image forming unit is arranged on a downstream side of the first image forming unit and is adjacent to the first image forming unit. An image forming apparatus further includes first and second photodischarging devices for discharging potential of the first and second photosensitive members respectively by irradiating thereon with light, wherein the first photodischarging device is turned off when the current is detected by applying the voltage to the second transfer member.

24 Claims, 10 Drawing Sheets

IMAGE FORMING APPARATUS

BACKGROUND OF THE INVENTION

1. Field of the Invention

The present invention relates to an electrophotographic type image forming apparatus including a copying machine, a printer, and a facsimile machine. More specifically, the present invention relates to an image forming apparatus that adjusts a transfer voltage to be applied to a transfer member for transferring a toner image onto a transfer material.

2. Description of the Related Art

An electrophotographic type image forming apparatus employs the following method. That is, an image forming process, such as charging process, exposure process, and development process, is performed on a surface of an electrophotographic photosensitive member such as a photosensitive drum or a photosensitive belt to thereby process a target image into a visible toner image, followed by transferring the toner image onto a transfer material by transfer process.

Recently, a transfer member such as a transfer roller has been widely used in the transfer process. The transfer member is a part of a transfer unit that is pressed against the photosensitive member via a transfer material (e.g., an intermediate transfer member or a transfer belt), and electrostatically transfers the toner image on a surface of the photosensitive member onto the transfer material in the transfer unit by applying a voltage to the photosensitive member.

On the other hand, it is known that a resistance of the transfer member to be used in the transfer process changes depending on temperature and humidity under the ambient atmosphere and operating time. According to the change of resistance, an optimum transfer voltage value for obtaining a transfer image of a good quality always changes.

More specifically, degradation of a transfer property may occur if a voltage value lower than the optimum voltage value is applied as a transfer voltage value. Specifically, in the case of a multicolor image forming apparatus, degradation of a color stabilization property may occur due to the degradation of the transfer property through operating hours.

On the other hand, if a voltage value higher than the optimum voltage value is applied, an abnormal electrical discharge may occur in a transfer nip portion, resulting in image degradation caused by the abnormal electrical discharge. Therefore, it is preferable to adjust the transfer voltage value according to the change of resistance of the transfer member.

In view of the above, Japanese Patent Application Laid-open No. 2001-125338 discusses a constant voltage control method according to an "active transfer voltage control (ATVC) method". More specifically, in the above method, a predetermined voltage value is applied to the transfer member before starting an image forming process and an output current value at the time is detected.

A resistance value between the transfer member and the photosensitive member is obtained based on the applied voltage and the detected current value, and the transfer voltage value to be applied to the transfer member at the time of forming a subsequent image is adjusted according to thus obtained resistance value.

On the other hand, an image forming apparatus, in which photodischarging (light neutralization) exposure process is performed on a surface of a photosensitive member after transfer process, is discussed in Japanese Patent Application Laid-open No. 60-147780. The photodischarging process can realize a good durability and has a high discharging property in comparison with discharging process in which a brush is brought into contact with an image carrier. That is, the photodischarging process is more advantageous than the discharging process using a brush.

According to the photodischarging exposure method, potential remaining on the surface of the photosensitive member generated between the transfer process and the charging process is discharged after the toner image is transferred onto the transfer member from the photosensitive member in the image forming process.

As a result of the above, uniform potential can be achieved for the photosensitive member before being charged for the next image forming process. Accordingly, the photosensitive member can be charged uniformly in the charging process for the next image forming process, and thereby the image degradation caused by a history of the residual charge is restrained.

Therefore, a method is widely used in which a photodischarging device such as a discharging LED is provided. The residual potential on the surface of the photosensitive member can be discharged, after a transfer process, by irradiating the surface of the photosensitive member with the photodischarging device after a transfer process.

However, a tandem type multicolor image forming apparatus, in which a plurality of image forming units, each including a photosensitive member, are arranged in parallel with a belt member which carries a recording material or a toner image, is reduced in size by reducing a distance between the adjacent photosensitive members. With the configuration described above, the distance between the adjacent photosensitive members becomes narrower. The photodischarging process causes the following problems if the photodischarging process is performed while the distance between the adjacent photosensitive members is made narrower.

Discharging light for discharging a first photosensitive member is initially irradiated onto a first electrophotographic photosensitive member, and, at the same time, is reflected by a surface of the first photosensitive member, a belt member, or the like.

The reflected discharging light (reflected light) is irradiated onto a second electrophotographic photosensitive member that is positioned at a downstream side of the first photosensitive member in a rotational direction of the belt member so as to be adjacent to the first photosensitive member. The reflected light is irradiated onto a region between a development unit of the second photosensitive member and a transfer unit.

At the time of forming an image, since a toner image is formed on the second photosensitive member in the above region, only a small adverse effect by the reflected light is exerted onto the image.

However, during the ATVC process, a process to form a toner image on the photosensitive member needs to be stopped. In order to shorten the stop time, a period of carrying out the ATVC process overlaps to each other between the adjacent image forming units in the image forming apparatus including a plurality of photosensitive members.

If the first photosensitive member is exposed to light from a discharging exposure device during the ATVC process, since no toner image is formed on the second photosensitive member during the ATVC process, potential of the photosensitive member in front of a transfer unit of the second photosensitive member varies because of the exposure to the reflected light.

If an amount of the reflected light is constant, no problem occurs when the image forming process is carried out at a transfer voltage set according to the ATVC process having been carried out in this situation. However, the state of the surface of the photosensitive member or the surface of the belt member changes according to the image forming process.

Therefore, if the ATVC process is carried out while there is the reflected light, an optimum transfer voltage may not be selected depending on a state of use of the image forming apparatus, which is not preferable.

A similar problem will also occur in a case where a transfer condition is set according to a process other than the ATVC process, which has been described above.

To solve the above problem, a shielding member may be provided in order to prevent the reflected light from irradiating. However, in the image forming apparatus having been downsized with a narrower distance between the adjacent photosensitive members, it is difficult to obtain a higher shielding property against the reflected light because there is only a limited space for installing the shielding member.

SUMMARY OF THE INVENTION

The present invention is directed to an image forming apparatus that can carry out a light discharging process and set a transfer condition with a high accuracy.

According to an aspect of the present invention, an image forming apparatus which forms an image on a recording material by using electrophotographic photosensitive members includes a rotatable belt member, a first image forming unit including a first photosensitive member and a first toner image forming device configured to form a toner image on the first photosensitive member, a first transfer member configured to transfer the toner image formed on the first photosensitive member onto the belt member, a second image forming unit including a second photosensitive member and a second toner image forming device configured to form a toner image on the second photosensitive member, the second image forming unit being arranged on a downstream side of the first image forming unit in a rotational direction of the belt member so as to be adjacent to the first image forming unit, a second transfer member configured to transfer the toner image formed on the second photosensitive member onto the belt member, a first photodischarging device configured to discharge a potential of the first photosensitive member by irradiating the first photosensitive member with light, a second photodischarging device configured to discharge a potential of the second photosensitive member by irradiating the second photosensitive member with light, and a setting unit configured to set a voltage to be applied to the second transfer member, when an image is formed, based on a current value detected by applying the voltage to the second transfer member when no image is formed, wherein the first photodischarging device is turned off when detecting the current by applying the voltage to the second transfer member.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
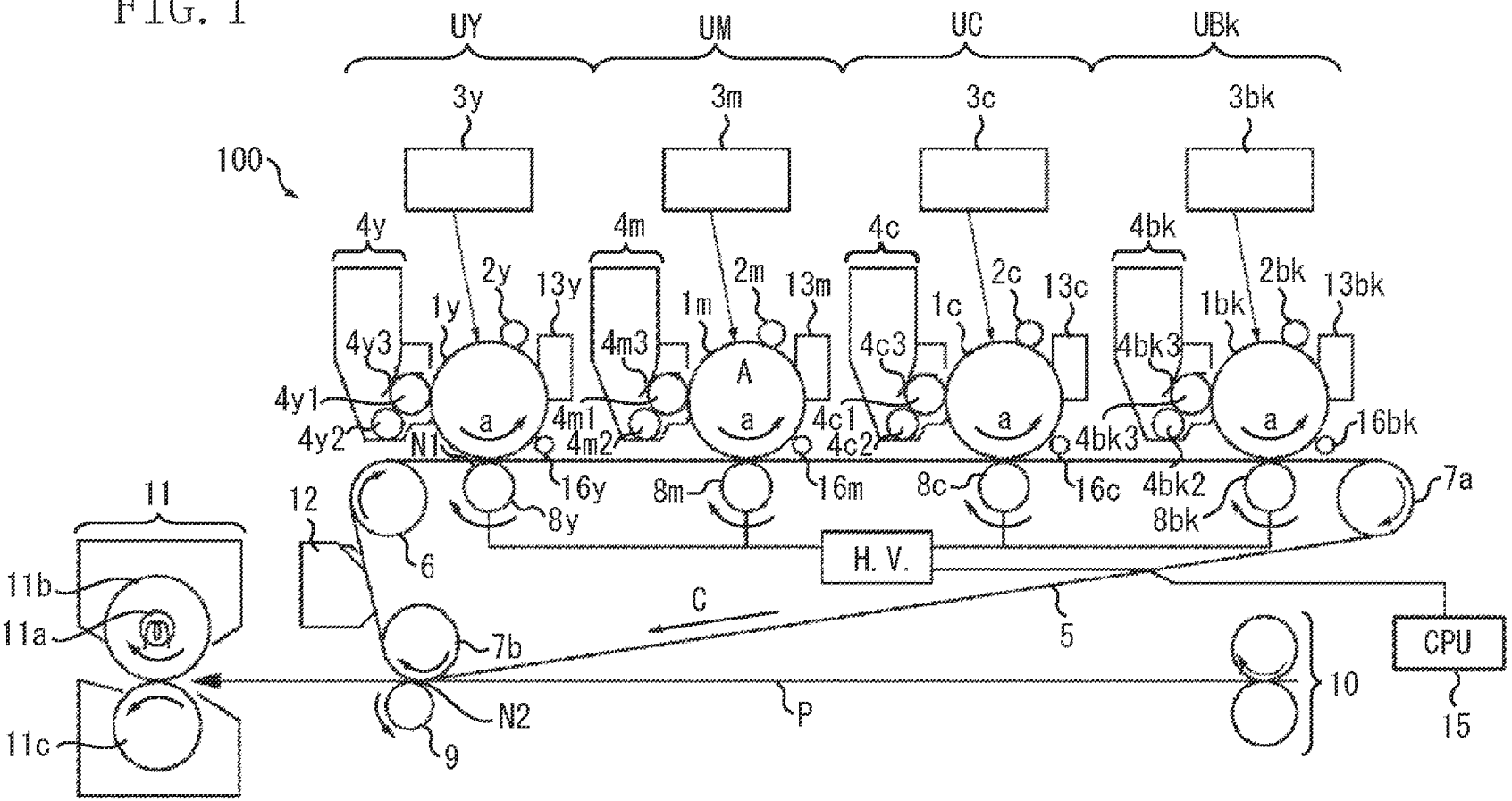
FIG. 1 is a schematic diagram illustrating a whole image forming apparatus according to an exemplary embodiment.

FIG. 1 is a schematic diagram of an image forming apparatus according to a present exemplary embodiment. As an image forming apparatus according to the present exemplary embodiment, a tandem type and an intermediate transfer type image forming apparatus will be described below.

In the above image forming apparatus, image forming units for different colors are arranged side by side along a flat portion of an intermediate transfer belt (transfer member) 5, which is a rotatable belt member. As illustrated in FIG. 1, an image forming apparatus 100 according to a first exemplary embodiment is a full color electrophotographic image forming apparatus including image forming units UY, UM, UC, and UBK corresponding to a yellow color toner, a magenta color toner, a cyan color toner, and a black color toner, respectively, which are arranged along the intermediate transfer belt 5 (the belt member).

An image forming process will be described below. In the image forming unit UY, a yellow toner image is formed on a photosensitive drum 1*y* (a first photosensitive member) to be primary transferred onto the intermediate transfer belt 5. In the image forming unit UM, a magenta toner image is formed on a photosensitive drum 1*m* (a second photosensitive member) to be primary transferred over the yellow toner image on the intermediate transfer belt 5.

In the image forming units UC and UBK, a cyan toner image and a black toner image are formed on each of the photosensitive drums 1*c* and 1*bk*, which correspond to a third photosensitive member and a fourth photosensitive member, respectively, to be similarly primary transferred over the toner image on the intermediate transfer belt 5 in this order.

Four color-toner images which have been primary transferred onto the intermediate transfer belt 5 are conveyed to a secondary transfer portion N2, formed by the roller pair 7*b* and a roller 9, according to rotation of the intermediate transfer belt 5, and are collectively secondary transferred onto a recording material P which is nipped and conveyed to the secondary transfer portion N2.

The recording material P onto which the toner images are secondary transferred by the secondary transfer portion N2 is heated and pressed by a fixing device 11. Accordingly, the toner images are fixed on a surface of the recording material P to thereafter be discharged to the outside.

The recording material P conveyed from a recording material feeder is further conveyed to a registration roller pair 10. The registration roller pair 10 receives the recording material P while it is in a stopped state and keeps the recording material P in a standby state at the registration roller pair 10. The Registration roller pair 10 then sends the recording material P to the secondary transfer portion N2 at the right timing with the toner image on the intermediate transfer belt 5.

In the fixing device 11, a pressure roller 11*c* is pressed against a fixing roller 11*b*, including a halogen lamp heater 11*a* in its core, in order to form a heating and pressing nip for the recording material P. A surface temperature of the fixing roller 11*b* is adjusted within a predetermined range by controlling a voltage to be supplied to the halogen lamp heater 11*a*.

During a process that the recording material P passes through the heating and pressing nip formed between the fixing roller 11*b* and the pressure roller 11*c*, which are rotating at a constant speed, the recording material P is pressed and heated almost at a constant pressure and temperature from both sides of the recording material P.

Accordingly, the unfixed toner image on the surface of the recording material P is fused and fixed onto the recording material P, thereby forming a full color image on the recording material P.

In a belt cleaner 12, a cleaning blade scrapes the intermediate transfer belt 5 to remove residual toner, paper dust, or the like, remaining on the surface of the intermediate transfer belt 5 after passing through the secondary transfer portion N2.

The image forming units UY, UM, UC, and UBK have the similar configuration with one another except that the development devices 4*y*, 4*m*, 4*c*, and 4*bk* installed in the corresponding image forming units UY, UM, UC, and UBK use different color toners, e.g., a yellow toner, a magenta toner, a cyan toner, and a black toner, respectively.

How to form a toner image in each of the image forming units is described below. Initially, a process to form a toner image on the image forming unit will be described. Since the image forming units have the similar configuration with one another except for a color of toner to be used by each image forming unit, the image forming unit for the yellow color toner will be exemplified in order to describe an image forming process performed in the image forming unit.

In the image forming unit UY for the yellow color toner in FIG. 1, the photosensitive drum 1*y* is rotationally driven in an arrow "a" direction. A charging member 2*y* is pressed against a surface of the photosensitive drum 1*y*. The charging member 2*y* rotates in accordance with rotation of the photosensitive drum 1*y*, is applied with a voltage, and thereby charges the surface of the photosensitive drum 1*y* up to a desired potential.

Subsequently, the photosensitive drum 1*y* is exposed to light by a laser beam scanner 3*y* (i.e., an exposure unit), based on image information to be recorded.

A development device 4*y* includes a development roller 4*y*1 configured to convey toner (i.e., a developer) to the surface of the photosensitive drum 1*y* and a developer supply roller 4*y*2 configured to apply toner onto a surface of the development roller 4*y*1 again. The development device 4*y* further includes a developer control blade 4*y*3 configured to control a coating amount of the toner applied onto the development roller 4*y*1.

The development roller 4*y*1 of which surface is uniformly coated with the toner by the developer control blade 4*y*3 is lightly pressed against the photosensitive drum 1*y*, rotated in a forward direction, and applied with a further voltage. As a result thereof, an electrostatic latent image on the photosensitive drum 1*y* is visualized as a toner image.

The toner image formed on the photosensitive drum 1*y* is conveyed to the primary transfer portion N1 formed between the intermediate transfer belt 5 and the photosensitive drum 1*y* according to the rotation of the photosensitive drum 1*y*.

The intermediate transfer belt 5 is formed into an endless sheet belt. In the present exemplary embodiment, the intermediate transfer belt 5 is stretched around a driving roller 6 and stretching roller pair 7*a* and 7*b*, and driven in an arrow "c" direction by a driving force from the driving roller 6.

The photosensitive drum 1*y* is pressed against a primary transfer roller 8*y* (i.e., a primary transfer member) via the intermediate transfer belt 5 to form the primary transfer portion N1. In the present exemplary embodiment, the primary transfer roller 8*y* is formed into a roller shape with a metal core covered by an elastic rubber layer, but may be formed into any one of a sheet shape, a blade shape, or a brush shape.

The toner image formed on the photosensitive drum 1*y* is conveyed to the primary transfer portion N1 formed between the intermediate transfer belt 5 and the photosensitive drum 1*y* in accordance with the rotation of the photosensitive drum 1*y*. At the primary transfer portion N1, the toner image is transferred onto the surface of the intermediate transfer belt 5 by a primary transfer voltage applied to the primary transfer roller 8*y*.

In the present exemplary embodiment, the primary transfer roller 8*y* is a first transfer member, a primary transfer roller 8*m* is a second transfer member, a primary transfer roller 8*c* is a third transfer member, and a primary transfer roller 8BK is a fourth transfer member.

Toner remaining on the photosensitive drum 1*y* after the transfer process is removed by a cleaning member 13*y* (i.e., cleaning blade) and ready for the next toner image forming process. As described above, a toner image is formed in each of the image forming units UM, UC, and UBK in a similar manner and subsequently primary transferred in this order.

In the present exemplary embodiment, the toner image forming unit includes a charging member, an exposure unit, a development device, and a cleaner. The toner image forming unit may not have the cleaning member.

The image forming apparatus according to the present exemplary embodiment includes an photodischarging member provided for each of the photosensitive drums as a photodischarging device in order to discharge the residual potential of the photosensitive drum after the primary transfer process. Discharging LEDs 16*y* (first photodischarging device), 16*m* (second photodischarging device), 16*c* (third photodischarging device), and 16*bk* (fourth photodischarging device) as the photodischarging members are arranged at positions where each of the discharging LEDs can irradiate the surface of each of the corresponding photosensitive drums 1*y*, 1*m*, 1*c*, and 1*bk* after the primary transfer process.

In the present exemplary embodiment, the discharging LED is arranged at a position in front of the cleaner and right behind the primary transfer portion in the rotational direction of the photosensitive drum 1. In the case of the image forming apparatus without the cleaning member, the discharging LED is arranged between the charging member and the primary transfer portion.

Further, the discharging LEDs are provided as a light emitting source throughout an image formable region in a rotational axis direction of the photosensitive drum 1 since the entire surface of the image forming region needs to be exposed to light of the discharging LEDs.

When downsizing the image forming apparatus, the image forming apparatus may be configured such that the discharging LEDs are provided at both ends in the rotational axis direction of the photosensitive drum 1 in order to have the discharging light irradiate in the rotational axis direction of the photosensitive drum 1.

In the present exemplary embodiment, the LED is used as the photodischarging device. However, a laser light, an analogue light such as a light of a halogen lamp, or a light that the analogue light is made into a monochromatic light by using a filter, a diffraction grating, or the like, may be irradiated instead of the LED light.

Figure 3:
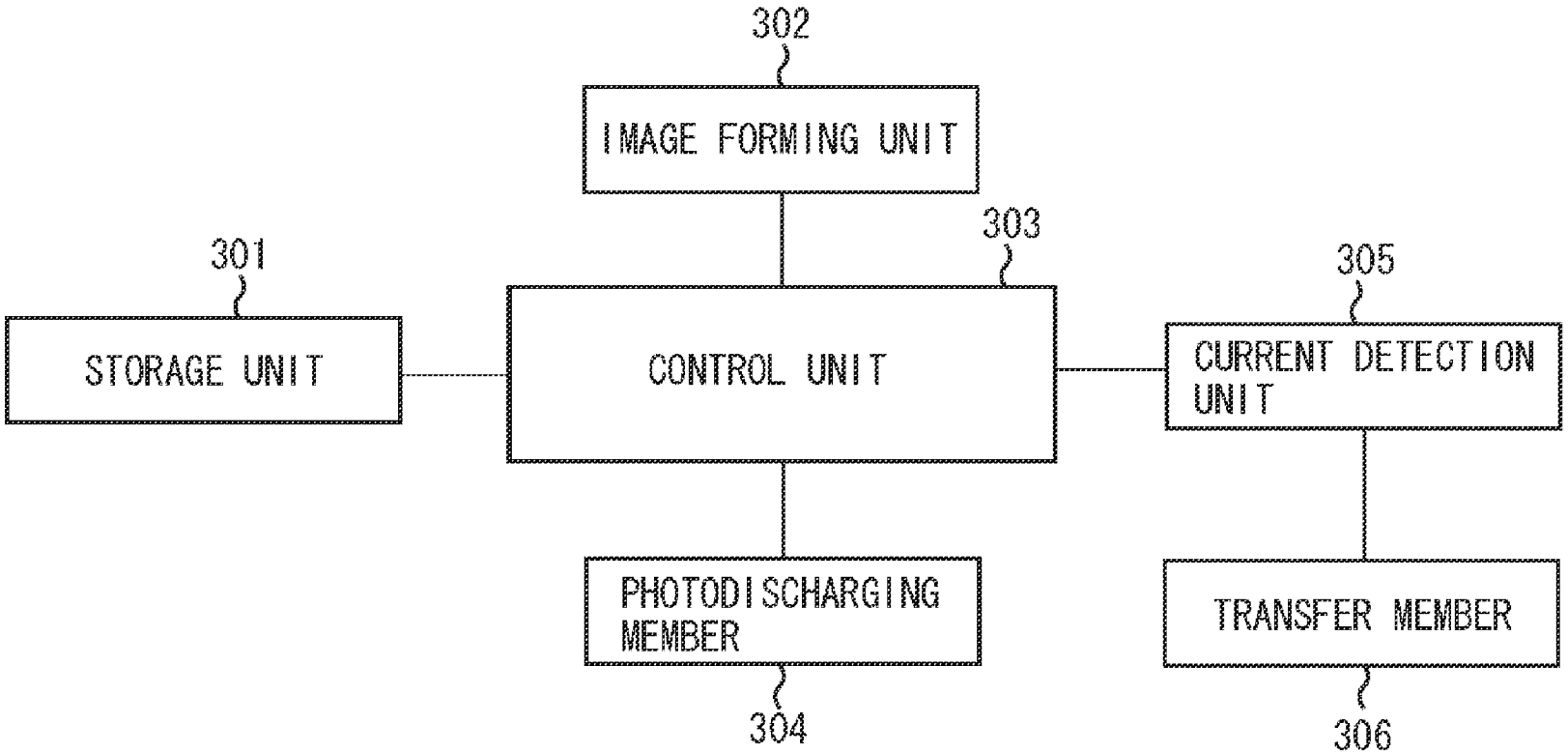
FIG. 3 is a block diagram illustrating a configuration of the image forming apparatus.

A block diagram of the image forming apparatus according to the present exemplary embodiment illustrated in FIG. 3 will be described below. In the present exemplary embodiment, the image forming apparatus includes a central process unit (CPU) 303 for controlling an image forming unit 302 and a photodischarging member 304 in the image forming apparatus.

The control unit 303 can set a transfer voltage, when an image is formed, based on a detection result of a current detection unit 305 which is configured to detect a transfer current of a transfer member 306. Also, the control unit 303 includes a storage unit 301 configured to store information for controlling the image forming process based on the information stored in the storage unit 301. The control unit 303 also controls operations of the photodischarging member 304.

A configuration of a high-voltage power supply 14 which provides the primary transfer voltage to be applied to the primary transfer rollers 8*y*, 8*m*, 8*c*, and 8*bk*, and a method for setting an output voltage value will be described below. The configuration of the high-voltage power supply 14 which applies the primary transfer voltage to each of the primary transfer rollers 8*y*, 8*m*, 8*c*, and 8*bk* and a method for detecting the output voltage values are similar to one another. Therefore, only the primary transfer roller 8*y* will be described as an example below.

Figure 2:
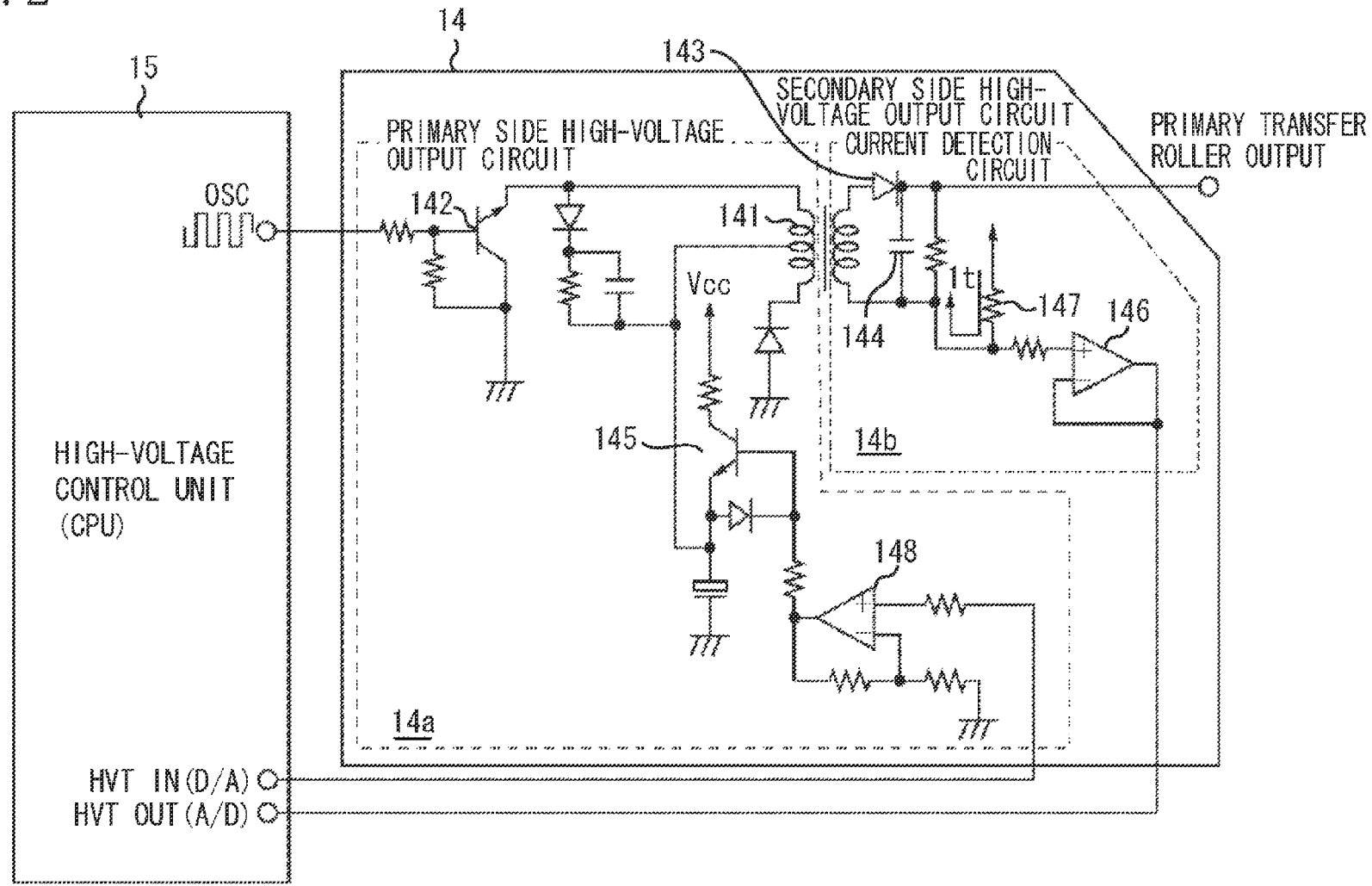
FIG. 2 is a schematic diagram illustrating a high-voltage power supply according to the exemplary embodiment.

FIG. 2 is a schematic diagram of the high-voltage power supply according to the present exemplary embodiment. The high-voltage power supply 14 typically includes a primary side high-voltage output circuit 14*a* and a secondary side high-voltage output circuit 14*b* including a current detection circuit (current detection unit).

In the present exemplary embodiment, a positive high-voltage is applied to the primary transfer roller 8*y*. The voltage is supplied from an inverter transformer 141. FIG. 2 illustrates one of the primary transfer high-voltage units.

The inverter transformer 141 is driven by a pulse signal OUC from the CPU 15 (i.e., the control unit), which is driven by a 5 volt power, through a transistor 142 of the primary side high-voltage output circuit 14*a*. The pulse signal OUC is applied to the primary transfer roller 8*y* after rectified by a diode 143 and a condenser 144 in the secondary side high-voltage output circuit 14*b* of the inverter transformer 141.

In the CPU 15 as the control unit, HVTIN is a digital-to-analogue (D/A) converted output and HVTOUT is an analogue-to-digital (A/D) converted input.

A direct current (DC) level of the primary transfer voltage is proportional to an emitter voltage of the transistor 145. Further, the output HVTIN (DC level signal) from the CPU 15 is amplified by an operational amplifier 148 to be input into a base of the transistor 145. Therefore, the transfer output voltage increases as the HVTIN increases.

The output current value at the time can be obtained by detecting a voltage drop across the resistance (resistance value R21) 147 using the operational amplifier 146. The CPU 15 can calculate the output current value I from the output (HVTOUT) of the operational amplifier 146 based on the following formula:

$$I=(5-HVT\mathrm{OUT})/R21.$$

Adjustment of the transfer voltage (hereinafter referred to as the "ATVC") according to the present exemplary embodiment will be described below. In the adjustment of the transfer voltage, the CPU 15 (i.e., the control unit) has a function of a setting unit for setting the transfer voltage.

The ATVC process employed in the present exemplary embodiment will be described below. First, a method for setting an applied transfer voltage (ATVC) will be described below. The ATVC process is performed while no image is formed. The primary transfer roller of the present image forming apparatus is made of a conductive urethane sponge. It is difficult for such a conductive roller to suppress a resistance fluctuation when the conductive roller is manufactured. Further, the resistance thereof varies according to changes in temperature and humidity in the ambient atmosphere or degradation of the durability.

On the other hand, when the transfer bias is controlled by a constant current control, the transfer voltage varies according to a printing rate or the like of the image to be transferred, which may cause a failure in transferring the optimum image. To solve the problem, the so-called ATVC process is employed.

When an image forming signal is input, the photosensitive drum 1 and the intermediate transfer belt 5 start rotating. Then, the control unit starts the ATVC process in response to the ATVC starting signal at a predetermined timing after the image forming signal is input.

A drum potential Vd is formed by applying a voltage to the charging member. The voltage applied to the charging member is the same as the voltage applied thereto when an image is formed so that the drum potential Vd may be the same potential as the potential when the image is formed.

Preliminary set adjusting voltage values V1, V2, and V3 are applied to the primary transfer roller to detect output current values at the time, e.g., I1 (at the time of applying the adjusting voltage value V1), I2 (at the time of applying the adjusting voltage value V2), or I3 (at the time of applying the adjusting voltage value V3), by the current detection unit.

Figure 4:
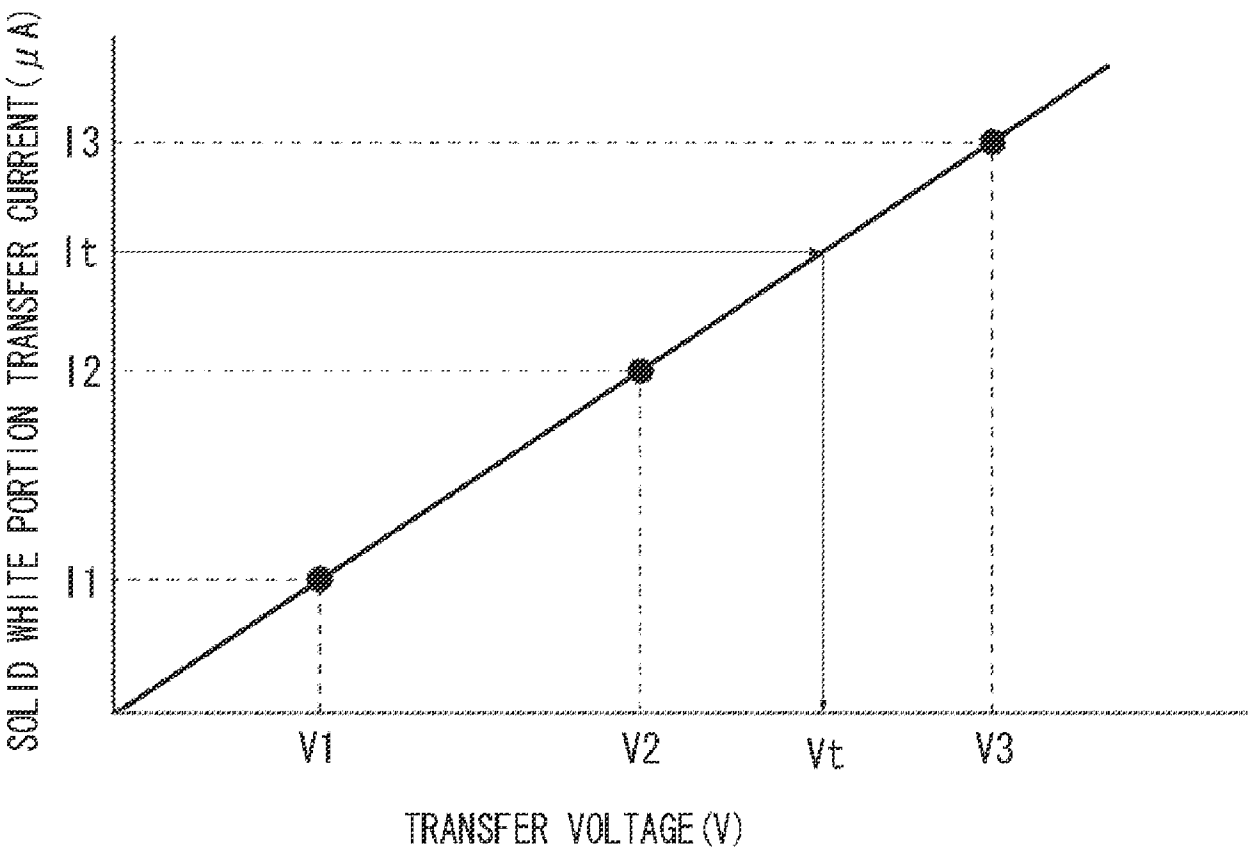
FIG. 4 is a schematic diagram illustrating an ATVC process according to the exemplary embodiment.

A relationship illustrated in FIG. 4 is obtained based on the above result, and thereby a first calculated voltage value Vt at which a predetermined target current value "It" can be obtained is calculated. The target current value corresponds to a voltage to be applied to the primary transfer roller when an image is formed, and can be changed according to an image forming condition which changes under the environmental fluctuation or the like. Thus calculated transfer voltage Vt is stored in the storage unit 301 and is applied to the primary transfer roller when an image is formed.

In the present exemplary embodiment, the ATVC process is performed under the following conditions.

(1) a pre-rotation of every job execution; and (2) a sheet interval for every constant number of sheets (every 100 sheets in the present exemplary embodiment) in the continuous job execution.

Herein, the target current value "It" is a value to be preliminarily set in the image forming apparatus as a current value at which an optimum transfer property can be obtained.

Figure 5:
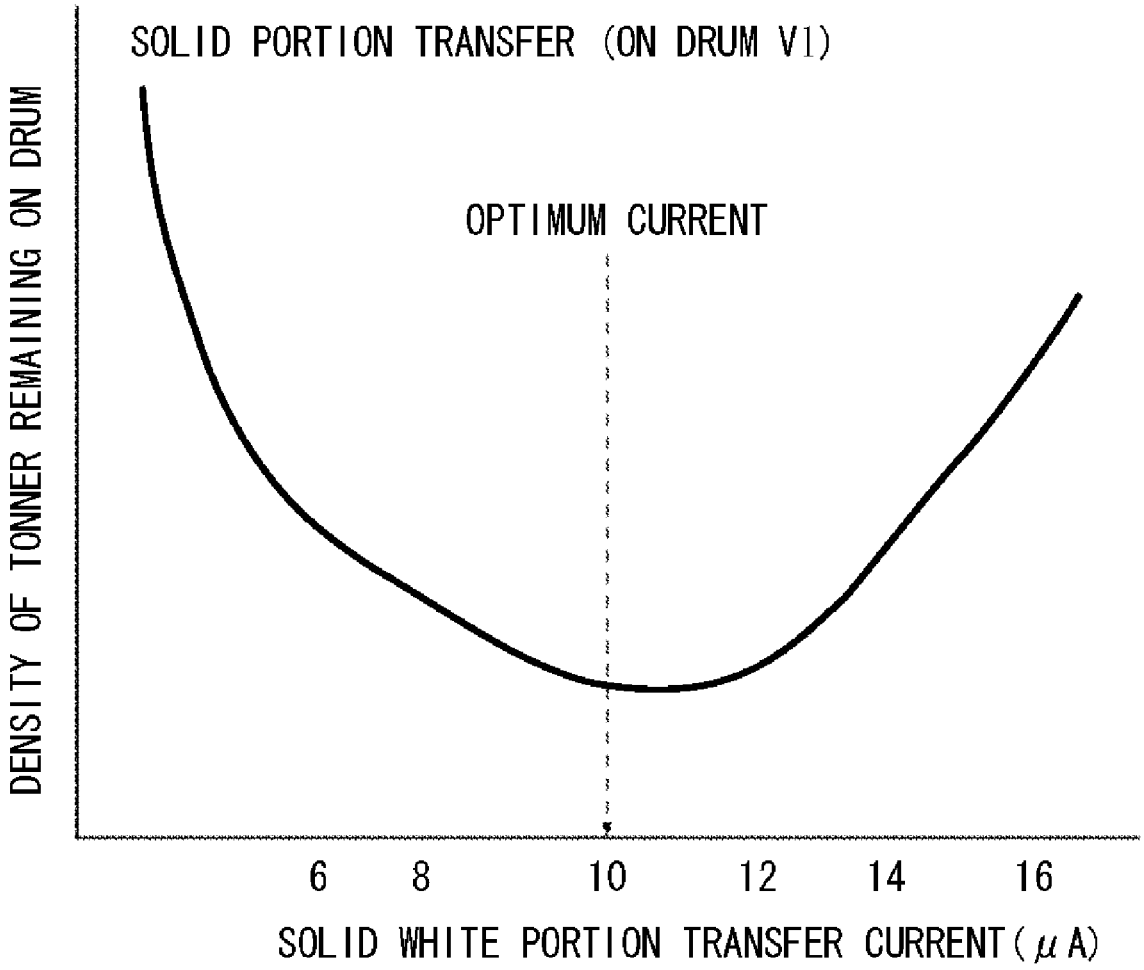
FIG. 5 is a graph illustrating a relationship between a solid white portion transfer current and a density of toner remaining on a drum.

FIG. 5 illustrates a density of toner remaining on the drum with respect to the transfer current (solid white portion). Since the image forming apparatus of the present exemplary embodiment is of a type of a reversal development system, a region on which a toner image is formed is an exposed portion (Vl) and a white background portion is a portion at which no exposure process is performed (Vd). Namely, a density of the residual toner after a solid image transfer process (where the drum potential is Vd).

In this case, the current value is set to a current value (10 μA) at which the density of the residual toner becomes minimum. The optimum current value is normally adjusted at the solid white portion (of which potential on the drum: Vd).

Figure 6:
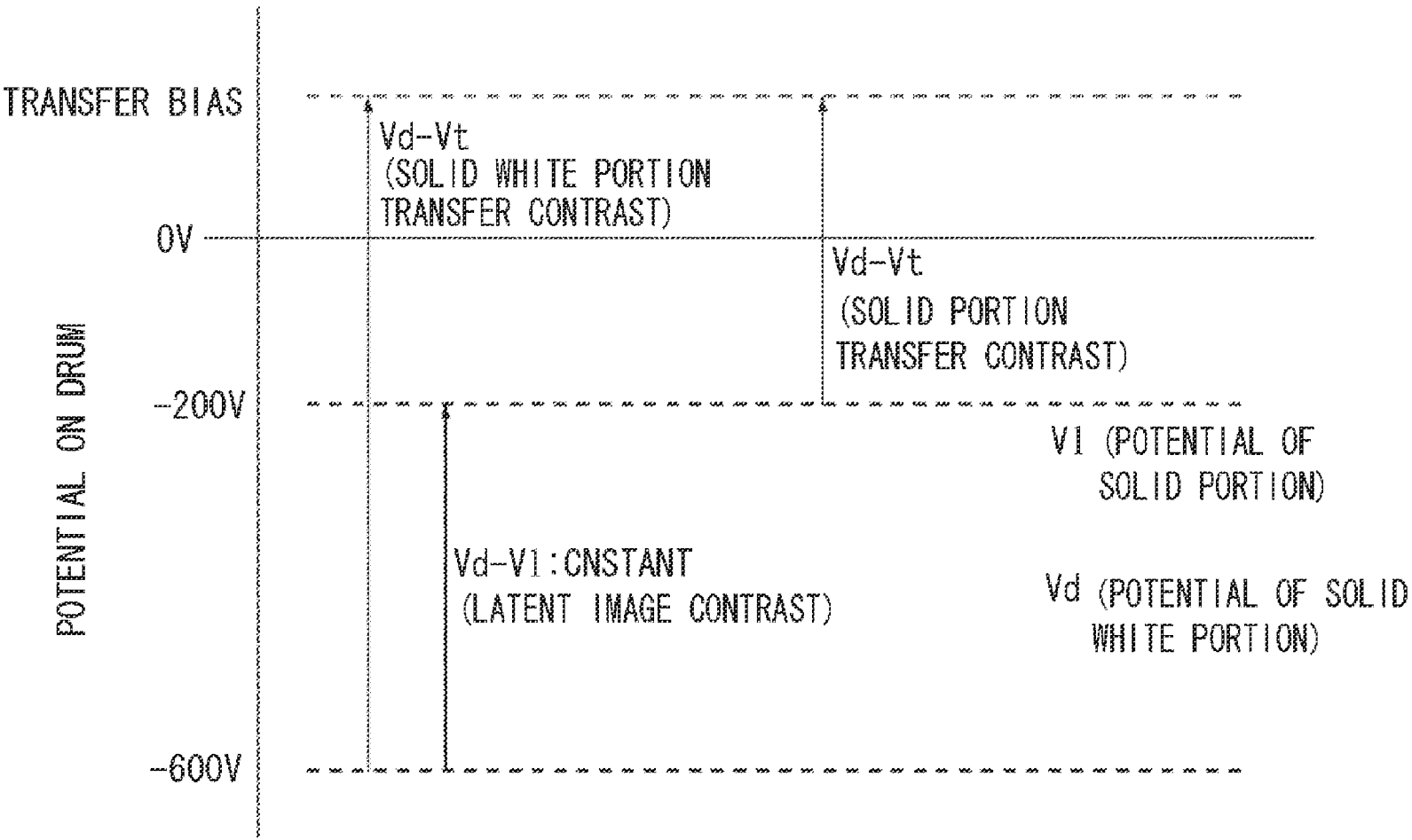
FIG. 6 is a schematic diagram illustrating potential on the dram.

FIG. 6 illustrates a potential on the photosensitive drum 1. The potential may vary according to a use condition of the image forming apparatus; however, since a potential difference between the potential of the solid white portion Vd and the potential of the solid black portion Vl (Vd−Vl) is set to be constant under the predetermined image forming condition, the current flowing into the solid black portion is predictable.

More specifically, since a value of Vd−Vl (latent image contrast) is constant, a value of Vd−Vt (solid white portion transfer contrast) becomes constant. As a result, a value of Vl−Vt (solid portion transfer contrast) becomes constant. A desired current can be obtained at the solid portion (Vl portion) according to the ATVC process performed (with respect to Vd) in the solid white portion.

In other words, when the Vd shows unpredictable change during the ATVC process, the current value of the Vl portion is also unpredictable.

An adverse effect caused by the discharging LED being irradiated onto a certain portion of the surface of the photosensitive member before the transfer process due to reflected light of the discharging LED reflected by the intermediate transfer belt arranged within the image forming apparatus will be studied below.

At the time, an image was formed at a process speed of 130 mm/sec, Vd=−600 V, and Vl=−200 V.

Figure 7:
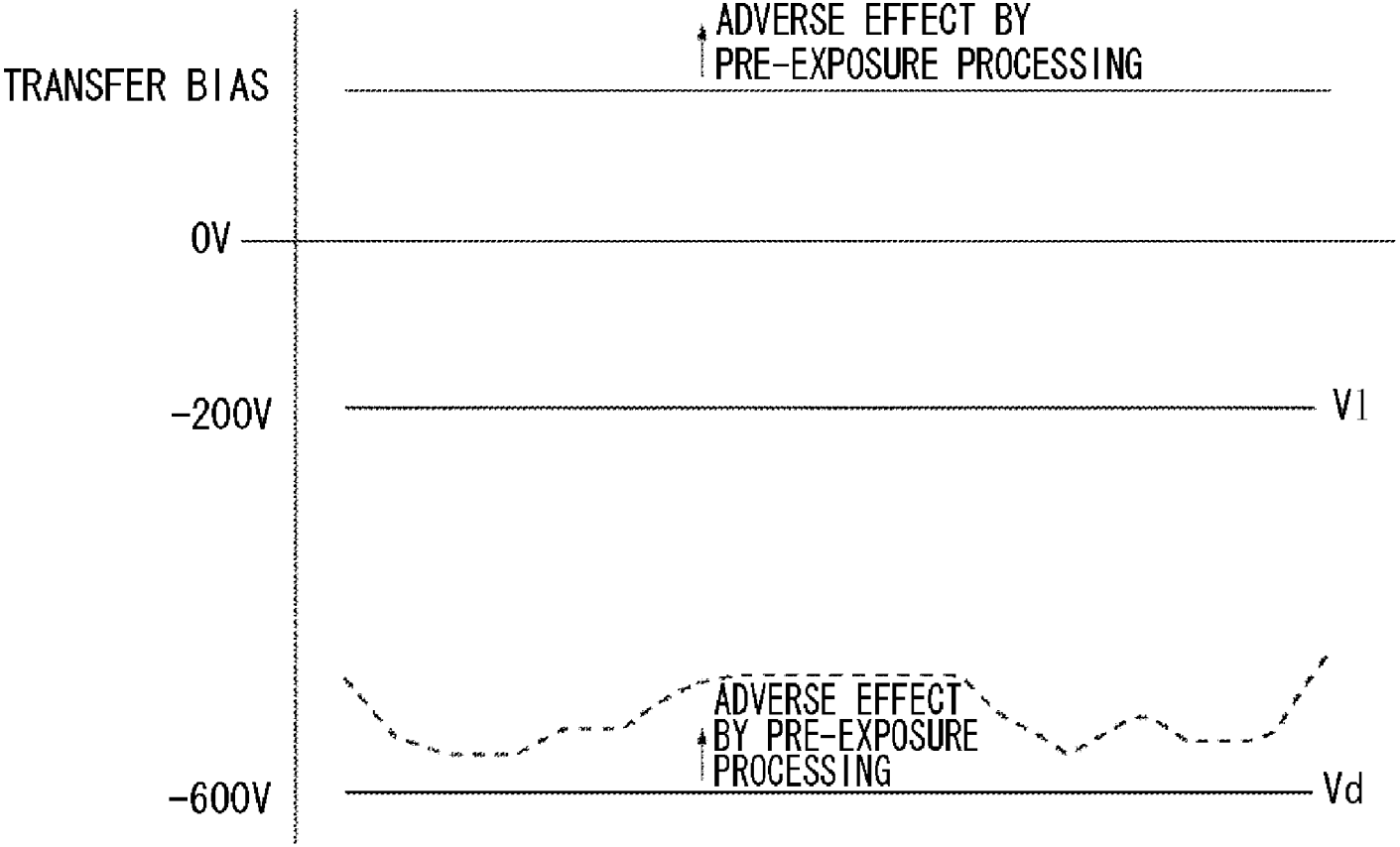
FIG. 7 illustrates potential on a drum according to a conventional example.

FIG. 7 illustrates an adverse effect caused by a diffused light of the discharging LED. For example, in FIG. 1, the light of the discharging LED of the first image forming unit Uy positioned at an upstream side in the rotational direction of the intermediate transfer belt 5 is reflected by the intermediate transfer belt 5, and therefore, exposes to the reflected light of the discharging LED a region between the development unit and the transfer unit of the second image forming unit UM which is positioned at a downstream side in the rotational direction of the intermediate transfer belt 5.

The first image forming unit includes a first toner image forming device, and the second image forming unit includes a second toner image forming device. Further, a toner image formed by the first image forming unit is transferred to the intermediate transfer belt 5 by the first transfer member, and a toner image formed by the second image forming unit UM is transferred to the intermediate transfer belt 5 by the second transfer member.

FIG. 7 illustrates a potential of the image forming unit UM before a transfer process. Vd before the image transfer process drops by about 100 V in FIG. 7 because of an adverse effect of the diffused reflection light of the discharging LED of the pre-exposure process. To the contrary, the Vl portion would not be suffered from the adverse effect of the pre-exposure process and thus a less potential variation is seen since there is a toner image on the drum.

As described above, there is a case where the potential of only the solid white portion, after the developing process, varies because of the adverse effect of the diffused reflection light of discharging LED of the pre-exposure process. However, no defect in image would occur since no adverse effect is exerted by the potential of the drum at which a toner image is actually developed.

However, the following problem will occur if the Vd varies due to the reflected light during the ATVC process. The charging member charges the photosensitive drum such that the potential on the photosensitive drum becomes the predetermined potential during the ATVC process. Therefore, the potential of the charged surface varies due to the reflected light caused by the pre-exposure process.

Figure 8:
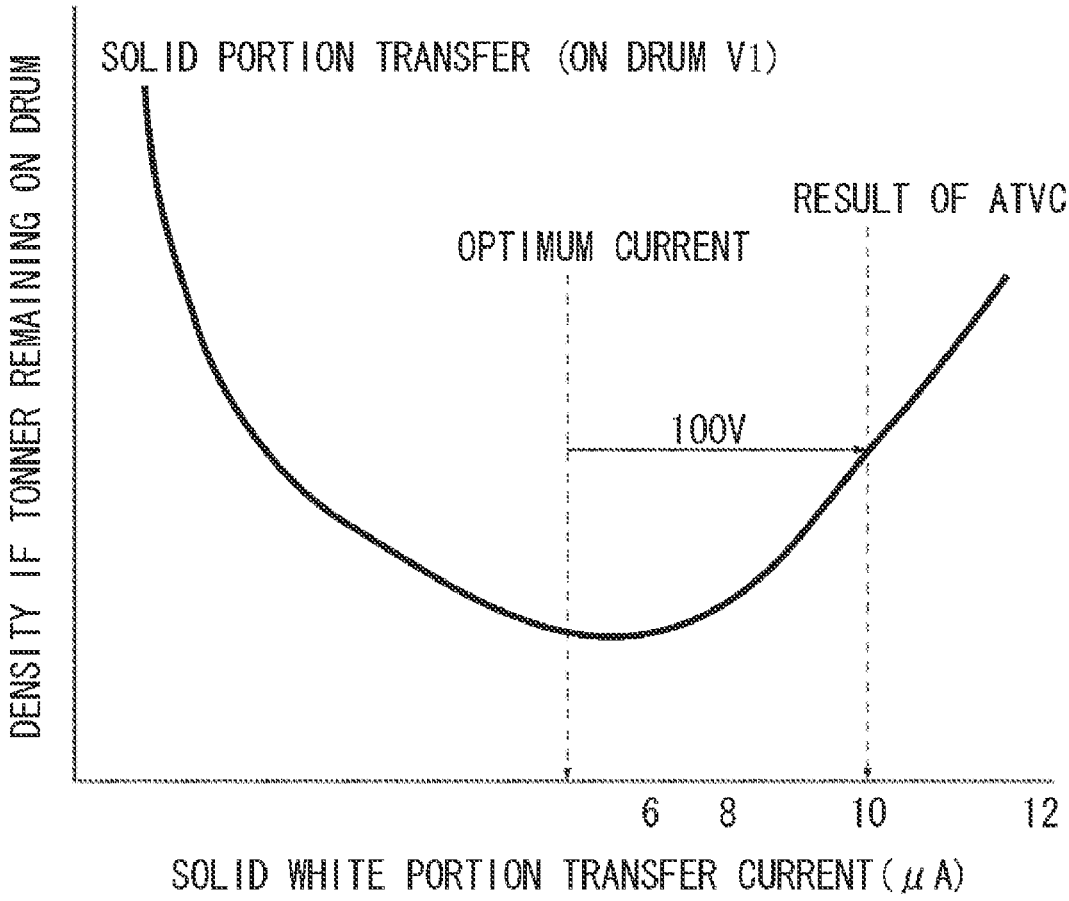
FIG. 8 is a graph illustrating a relationship between solid white portion current and density of toner remaining on the drum according to the conventional example.

In the present exemplary embodiment, the following problem will occur since the charged potential is set to be Vd. Since the Vd−Vl contrast is smaller by 100 V than an expected value, the optimum voltage of Vl shifts to a higher current value by 100 V. As a result, the drum comes to be overloaded as it is illustrated in FIG. 8, thereby producing a badly transferred image.

In view of the above, the present invention is directed to an image forming apparatus in which, during the ATVC process, the photodischarging member is turned off or a light amount emitted from the photodischarging member is adjusted to be smaller than a light amount emitted during the image forming process.

A position of the photodischarging member will be described below. As illustrated in FIG. 1, each of the photodischarging members or the discharging LEDs is positioned at a downstream side of the transfer unit and at an upstream side of the cleaning unit in the rotational direction of the photosensitive drum 1 of each image forming unit.

In the present exemplary embodiment, the image forming units are positioned side by side. Therefore, the development device is provided at a position between the discharging LED and the image exposure unit of the adjacent image forming unit.

To describe more specifically, positions of the image forming unit UY and the image forming unit UM will be described below. The positional relationship to be described is similar to that of the other image forming units. The development device 4*m* is positioned on a straight line which connects an image exposure unit A on the photosensitive drum 1*m* of the image forming unit UM and the discharging LED 16*y* of the image forming unit UY.

Therefore, even if the discharging LED 16*y* is turned on during the image forming process, an adverse effect to an latent image formation performed by the adjacent image forming unit can be minimized. The light emitted from the discharging LED 16*y* is reflected almost by the surface of the intermediate transfer belt 5 to be irradiated onto a front portion of the transfer unit of the image forming unit UM.

The light of the discharging LED 16*y* reflected by the intermediate transfer belt 5 is blocked by the development device 4*m* before the light reaches the image exposure unit A of the image forming unit UM. Therefore, the light reflected by the intermediate transfer belt 5 does not irradiate the photosensitive drum 1*m* at the upstream side of the development device 4*m* in the rotational direction of the photosensitive drum 1*m*.

A case where the photodischarging member is turned off during the ATVC process will be described.

Figure 9:
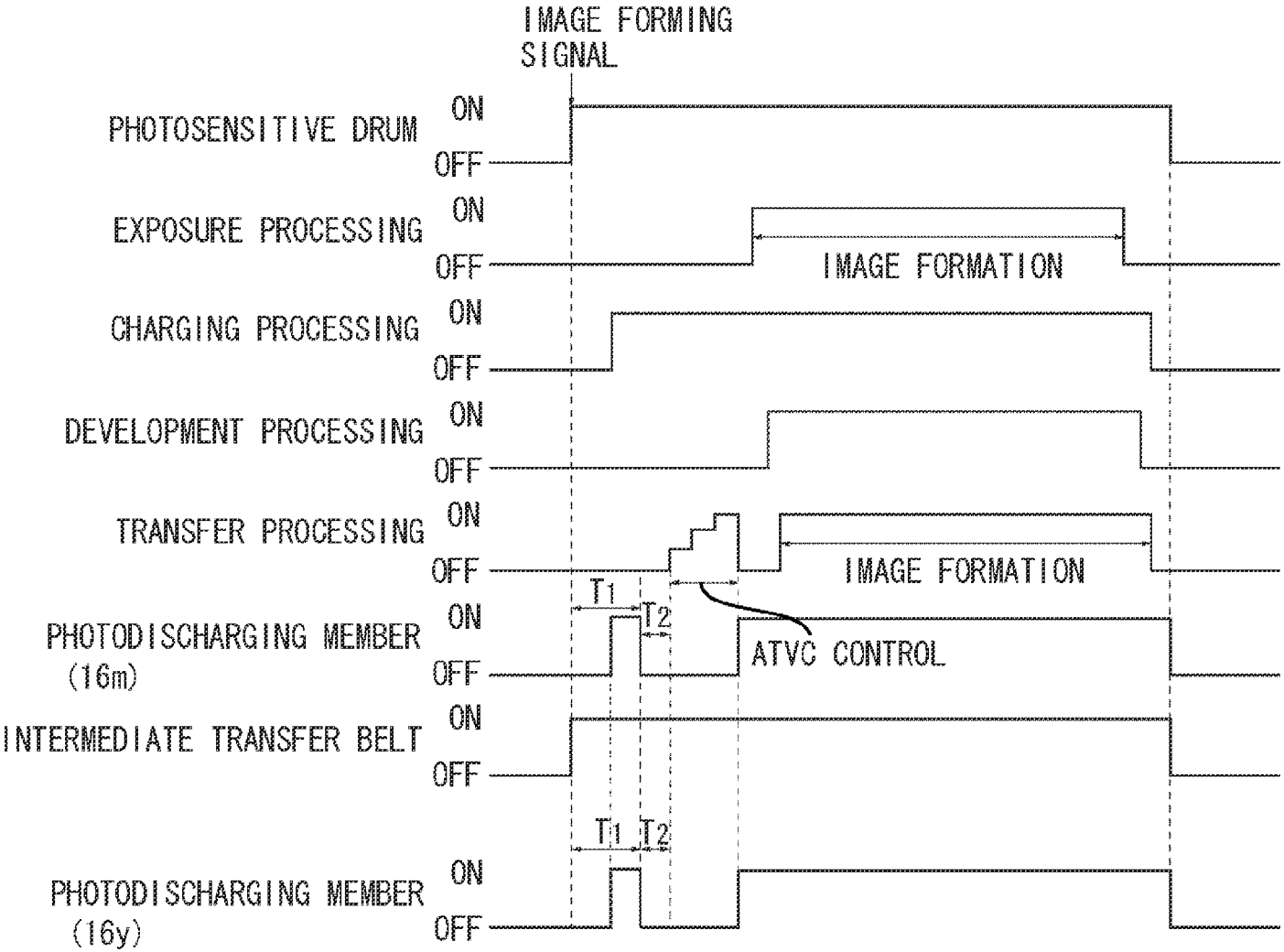
FIG. 9 is a timing chart of an image forming process according to the exemplary embodiment.

FIG. 9 is a timing chart illustrating that the ATVC process is performed before starting the image formation according to the present exemplary embodiment. The timing chart relates to the image forming unit UM.

Image forming start timings differ from one another between the image forming units, but a timing at which the rotation of the photosensitive drums and the intermediate transfer belt starts and a timing at which the ATVC process starts are the same between the image forming units.

In the present exemplary embodiment, the timings will be described blow with reference to a timing chart relating to the image forming unit UM before the image is started to be formed. In the present exemplary embodiment, the CPU has a function of a photodischarge control unit that controls ON/OFF of the photodischarging members.

When an image forming signal is input, the photosensitive drum 1*m* and the intermediate transfer belt 5 start rotating, and a voltage is applied to the charging member at a predetermined timing after the image forming signal is input.

Also, the photodischarging member starts to emit light at a predetermined timing T1 after the image forming signal is input, thereby eliminating an irregularity of the potential remaining on the photosensitive drum.

To eliminate the irregularity of the potential remaining on the photosensitive drum, at least one entire round of the photosensitive drum is to be discharged. In the present exemplary embodiment, the ATVC process is performed while the pre-rotation of the image forming process. The ATVC process is started at a predetermined timing (T1+T2) after the image forming signal is input.

A time T2 between when the photodischarging member is turned off and when the ATVC process is started will be described below. The region between the development unit and the transfer unit on the photosensitive drum 1*m* of the image forming unit UM, at the time when the discharging LED 16*y* is turned off, is adversely affected by the diffused light emitted when the discharging LED 16*y* has been on.

Therefore, an accurate detection can not be achieved if the region overlaps the region where the ATVC process is performed. In order to avoid the above problem, at least a certain time period, in which the development unit of the photosensitive drum 1*m*, while the discharging LED 16*y* is turned off, passes through the transfer portion, is to be secured.

In view of the above, T2 may be a time more than a time of a distance/process speed between the development unit and the transfer portion. As described above, the ATVC process is to be started within (T1+T2) second(s) after the image forming signal is input.

In the present exemplary embodiment, the ATVC process is performed simultaneously by each of the image forming units UY, UM, UC, and UBK. At least during the ATVC process, all the discharging LEDs of the image forming units are off.

In the present exemplary embodiment, all the discharging LEDs are turned off, but the discharging LED 16BK may be kept on since the discharging LED 16BK would not exert any adverse effect on the adjacent image forming unit.

At the end of the ATVC process or within a predetermined time period after the end of the ATVC process, the discharging LED starts to irradiate. Thereafter, a normal image forming process will be performed.

If it is before the image forming process, the discharging LEDs may be continuously off from when the image forming signal is input to when the ATVC process is ended.

Figure 10:
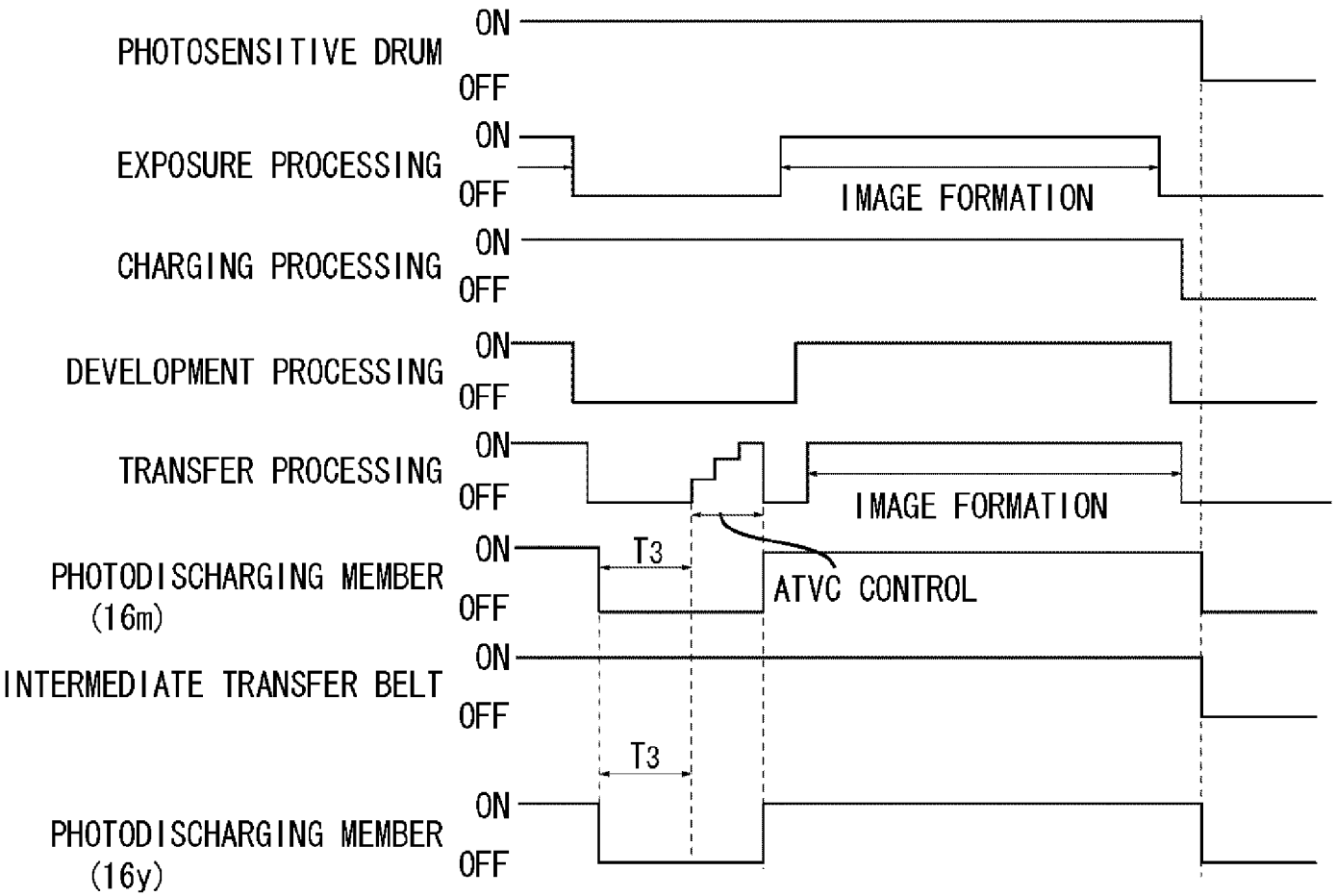
FIG. 10 is a timing chart illustrating operations performed during a paper interval according to the exemplary embodiment.

FIG. 10 is a timing chart illustrating timings for sending sheets in the image forming unit UM. The ATVC process performed in the paper interval is the same control as the ATVC process performed during the above described pre-rotation.

The discharging LED of each of the image forming units is on, in order to perform the image forming process before coming into the sheet interval. While the discharging LED is on, the photosensitive drum 1 is to be discharged for at least one round of the photosensitive drum 1 in order to eliminate the non-uniformity of the potential.

In the present exemplary embodiment, all the discharging LEDs are to be turned off at the same timing when the ATVC process is performed in the paper interval. The ATVC process is started within a predetermined time T3 (>T2) second(s) after the discharging LEDs are turned off. Then, at the time when the ATVC process ends or within a predetermined time period after the end of the ATVC process, the discharging LEDs are started to be irradiated.

In the present exemplary embodiment, the photodischarging members are turned off, but the photodischarging members may be kept emitting light with a small light amount that can minimize the potential variation caused by the diffused light. However, in this case, the light amount should be less than the light amount emitted during the image forming process.

Further, in the present exemplary embodiment, the ATVC process performed before the image forming process is similar to the ATVC process performed in the sheet interval. However, the number of applied voltages in the ATVC process performed in the paper interval may be set smaller in order to shorten the time required for the ATVC process performed between sheets. Also, in the case of performing a simplified ATVC process when high detection accuracy is not expected, the photodischarging members may be on under the same conditions as the ATVC process performed during the image forming process.

Further, only the photodischarging member of the UBK, which is arranged at an end and thus would not exert any adverse effect to the adjacent image forming unit, may be kept on.

Still further, in the present exemplary embodiment, the intermediate transfer belt 5 is used as a belt member. However, a similar effect can be obtained if a transfer belt, which conveys recording materials, is used as the belt member.

The image forming apparatus according to the present exemplary embodiment includes the cleaner. However, the present invention is also applicable to a cleanerless image forming apparatus without the cleaner.

According to the exemplary embodiment of the present invention, a highly accurate transfer condition can be set even with the image forming apparatus includes the photosensitive members with shorter distance therebetween and with photodischarging members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-190942 filed Jul. 24, 2008, which is hereby incorporated by reference herein in its entirety.

What is claimed is:

1. An image forming apparatus which forms an image on a recording material by using electrophotographic photosensitive members, the image forming apparatus comprising:

a rotatable belt member;

a first image forming unit including a first photosensitive member and a first toner image forming device configured to form a toner image on the first photosensitive member;

a first transfer member configured to transfer the toner image formed on the first photosensitive member onto the belt member;

a second image forming unit including a second photosensitive member and a second toner image forming device configured to form a toner image on the second photosensitive member, the second image forming unit being arranged on a downstream side of the first image forming unit in a rotational direction of the belt member so as to be adjacent to the first image forming unit;

a second transfer member configured to transfer the toner image formed on the second photosensitive member onto the belt member;

a first photodischarging device configured to discharge a potential of the first photosensitive member by irradiating the first photosensitive member with light;

a second photodischarging device configured to discharge a potential of the second photosensitive member by irradiating the second photosensitive member with light; and a setting unit configured to set a voltage to be applied to the second transfer member, when an image is formed, based on a current value detected by applying the voltage to the second transfer member when no image is formed, wherein the first photodischarging device is turned off when the current value is detected by applying the voltage to the second transfer member.

2. The image forming apparatus according to claim 1, wherein each of the first and second toner image forming devices includes a charging member configured to charge each of the first and second electrophotographic photosensitive members, and the first and second photodischarging devices discharge potential of the first and second photosensitive members respectively, after a transfer process is performed, between a charging portion and a transfer portion.

3. The image forming apparatus according to claim 1, wherein each of the first and second toner image forming devices includes a cleaning member configured to remove toner remaining on each of the first and second electrophotographic photosensitive members after the transfer process is performed, and the first and second photodischarging devices discharge potential of the first and second electrophotographic photosensitive members respectively, after the transfer process is performed, between a cleaning portion and a transfer portion.

4. The image forming apparatus according to claim 1, wherein the first photodischarging device is turned off after discharging the first photosensitive member for at least one round of the first photosensitive member.

5. The image forming apparatus according to claim 1, further comprising a plurality of image forming units, wherein the setting unit can set a voltage to be applied to each of the first and second transfer members, when an image is formed, by applying the voltage to each of the first and second transfer members, and the first and second photodischarging devices are turned off when the setting unit starts the setting operation before an image is started to be formed.

6. The image forming apparatus according to claim 1, further comprising a plurality of image forming units, wherein the setting unit can set a voltage to be applied to each of the first and second transfer members, when an image is formed, by applying the voltage to each of the first and second transfer members, and the first and second photodischarging devices are turned off after discharging each of the first and second photosensitive members for at least one round of the first and second photosensitive members when the setting unit starts the setting operation between an image forming process and the following image forming process.

7. An image forming apparatus which forms an image on a recording material by using electrophotographic photosensitive members, the image forming apparatus comprising:

a rotatable belt member configured to carry the recording material;

a first image forming unit including a first photosensitive member and a first toner image forming device configured to form a toner image on the first photosensitive member;

a first transfer member configured to transfer the toner image formed on the first photosensitive member onto the recording material on the belt member;

a second image forming unit including a second photosensitive member and a second toner image forming device configured to form a toner image on the second photosensitive member, the second image forming unit being arranged on a downstream side of the first image forming unit in a rotational direction of the belt member so as to be adjacent to the first image forming unit;

a second transfer member configured to transfer the toner image formed on the second photosensitive member onto the recording material on the belt member;

a first photodischarging device configured to discharge a potential of the first photosensitive member by irradiating the first photosensitive member with light;

a second photodischarging device configured to discharge a potential of the second photosensitive member by irradiating the second photosensitive member with light; and a setting unit configured to set a voltage to be applied to the second transfer member, when an image is formed, based on a current value detected by applying a voltage to the second transfer member when no image is formed, wherein the first photodischarging device is turned off when the current value is detected by applying the voltage to the second transfer member.

8. The image forming apparatus according to claim 7, wherein each of the first and second toner image forming devices includes a charging member configured to charge each of the first and second photosensitive members, and the first and second photodischarging devices discharge potential of the first and second photosensitive members respectively, after a transfer process is performed, between a charging portion and a transfer portion.

9. The image forming apparatus according to claim 7, wherein each of the first and second toner image forming devices includes a cleaning member configured to remove toner remaining on each of the first and second photosensitive members after a transfer process is performed, and the first and second photodischarging devices discharge potential of the first and second photosensitive members respectively, after a transfer process is performed, between a cleaning portion and a transfer portion.

10. The image forming apparatus according to claim 7, wherein the first photodischarging device is turned off after discharging the first photosensitive member for at least one round of the first photosensitive member.

11. The image forming apparatus according to claim 7, further comprising a plurality of image forming units, wherein the setting unit can set a voltage to be applied to each of first and second transfer members, when an image is formed, by applying a voltage to each of the first and second transfer members, and of the first and second photodischarging devices are turned off when the setting unit starts the setting operation before the image is started to be formed.

12. The image forming apparatus according to claim 7, further comprising a plurality of image forming units, wherein the setting unit can set a voltage to be applied to each of the first and second transfer members, when an image is formed, by applying the voltage to each of the first and second transfer members, and the first and second photodischarging devices are turned off after discharging each of the first and second photosensitive members with light for at least one round of each of the first and second photosensitive members when the setting unit starts the setting operation between an image forming process and the following image forming process.

13. An image forming apparatus which forms an image on a recording material by using electrophotographic photosensitive members, the image forming apparatus comprising:

a rotatable belt member;

a first image forming unit including a first photosensitive member and a first toner image forming device configured to form a toner image on the first photosensitive member;

a first transfer member configured to transfer the toner image formed on the first photosensitive member onto the belt member;

a second image forming unit arranged on a downstream side of the first image forming unit in a rotational direction of a second photosensitive member and the belt member so as to be adjacent to the first image forming unit;

a second transfer member configured to transfer a toner image formed on the second photosensitive member onto the belt member;

a first photodischarging device configured to discharge a potential of the first photosensitive member by irradiating light onto the first photosensitive member;

a second photodischarging device configured to discharge a potential of the second photosensitive member by irradiating light onto the second photosensitive member; and a setting unit configured to set a voltage to be applied to the second transfer member, when an image is formed, based on a current value detected by applying the voltage to the second transfer member when no image is formed, wherein a light amount emitted by the first photodischarging device is set to be less than a light amount emitted when an image is formed, when the current value is detected by applying the voltage to the second transfer member.

14. The image forming apparatus according to claim 13, wherein each of the first and second toner image forming devices includes a charging member configured to charge each of the first and second photosensitive members, and the first and second photodischarging devices discharge potential of the first and second photosensitive members respectively, after a transfer process is performed, between a charging unit and a transfer unit.

15. The image forming apparatus according to claim 13, wherein each of the first and second toner image forming devices includes a cleaning member configured to remove toner remaining on each of the first and second photosensitive members after a transfer process is performed, and the first and second photodischarging devices discharge potential of the first and second photosensitive members respectively, after the transfer process is performed, between a cleaning unit and a transfer unit.

16. The image forming apparatus according to claim 13, wherein an amount of light to be emitted from the first photodischarging device is reduced after discharging the first photosensitive member for at least one round of the first photosensitive member.

17. The image forming apparatus according to claim 13, further comprising a plurality of image forming units, wherein the setting unit can set a voltage to be applied to each of the first and second transfer members, when an image is formed, by applying the voltage to each of the first and second transfer members, and light amounts of photodischarging devices are reduced when the setting unit starts the setting operation before the image is started to be formed.

18. The image forming apparatus according to claim 13, further comprising a plurality of image forming units, wherein the setting unit can set a voltage to be applied to each of the first and second transfer members, when an image is formed, by applying the voltage to each of the first and second transfer members, and light amounts of all of the first and second photodischarging devices are reduced after discharging by light each of the first and second photosensitive members for at least one round of the first and second photosensitive members when the setting unit starts the setting operation between an image forming process and the following image forming process.

19. An image forming apparatus which forms an image on a recording material by using electrophotographic photosensitive members, the image forming apparatus comprising:

a rotatable belt member configured to carry the recording material;

a first image forming unit including a first photosensitive member and a first toner image forming device configured to form a toner image on the first photosensitive member;

a first transfer member configured to transfer the toner image formed on the first photosensitive member onto the recording material on the belt member;

a second image forming unit including a second photosensitive member and a second toner image forming device configured to form a toner image on the second photosensitive member, the second image forming unit being arranged on a downstream side of the first image forming unit in a rotational direction of the belt member so as to be adjacent to the first image forming unit;

a second transfer member configured to transfer the toner image formed on the second photosensitive member onto the recording material on the belt member;

a first photodischarging device configured to discharge a potential of the first photosensitive member by irradiating the first photosensitive member with light;

a second photodischarging device configured to discharge a potential of the second photosensitive member by irradiating the second photosensitive member with light; and a setting unit configured to set a voltage to be applied to the second transfer member, when an image is formed, based on a current value detected by applying the voltage to the second transfer member, wherein a light amount emitted from the first photodischarging device is set smaller than a light amount emitted during an image forming process, when the current value is detected by applying the voltage to the second transfer member.

20. The image forming apparatus according to claim 19, wherein each of the first and second toner image forming devices includes a charging member configured to charge each of the first and second photosensitive members, and the first and second photodischarging devices discharge potential of the first and second photosensitive members respectively, after a transfer process, between a charging portion and a transfer portion.

21. The image forming device according to claim 19, wherein each of the first and second toner image forming devices includes a cleaning member configured to remove toner remaining on the first and second photosensitive members respectively after a transfer process is performed, and the first and second photodischarging devices discharge potential of the first and second photosensitive members, after the transfer process is performed, between a cleaning portion and a transfer portion.

22. The image forming apparatus according to claim 19, wherein a light amount emitted from the first photodischarging device is reduced after discharging the first photosensitive member for at least one round of the first photosensitive member.

23. The image forming apparatus according to claim 19, further comprising a plurality of image forming units, wherein the setting unit can set a voltage to be applied to each of the first and second transfer members, when an image is formed, by applying a voltage to each of the first and second transfer members, and light amounts of all of photodischarging devices are reduced when the setting unit starts the setting operation before an image is started to be formed.

24. The image forming apparatus according to claim 19, further comprising a plurality of image forming units, wherein the setting unit can set a voltage to be applied to each of the first and second transfer members, when an image is formed, by applying the voltage to each of the first and second transfer members, and light amounts of the first and second photodischarging devices are reduced after discharging by light each of the first and second photosensitive members for at least one round of the first and second photosensitive members, when the setting unit starts the setting operation between an image forming process and the following image forming process.

* * * * *